United States Patent [19]

Jones

[11] 4,065,873

[45] Jan. 3, 1978

[54] FLYING SAUCER TOY

[76] Inventor: Robert Alexander Jones, 23405 Caminito Telmo, Laguna Hills, Calif. 92653

[21] Appl. No.: 718,998

[22] Filed: Aug. 30, 1976

[51] Int. Cl.[2] ..... A63H 27/12

[52] U.S. Cl. ..... 46/75; 244/17.11; 273/106 B

[58] Field of Search ..... 46/75, 74 R, 74 D, 82; 273/106 B; 244/12.4, 17.11

[56] References Cited

U.S. PATENT DOCUMENTS

| | | | |
|---|---|---|---|
| D. 209,763 | 1/1968 | Mueller | D34/15 |
| 2,949,693 | 8/1960 | McRoskey | 46/75 |
| 3,394,906 | 7/1968 | Rogers | 46/75 |
| 3,477,168 | 11/1969 | Trodglen, Jr. | 46/75 |
| 3,488,882 | 1/1970 | Scott | 46/74 R |
| 3,518,788 | 7/1970 | Sides | 46/75 |
| 3,568,358 | 10/1968 | Bruce | 46/75 |

*Primary Examiner*—John F. Pitrelli
*Assistant Examiner*—Mickey Yu
*Attorney, Agent, or Firm*—Sughrue, Rothwell, Mion, Zinn and Macpeak

[57] ABSTRACT

The hollow, molded plastic annular body of a flying saucer toy includes integrally molded circumferentially spaced tetrahedrons projecting outwardly from the lower wall radially external of the body central opening and pitched in opposition to the propeller to stabilize the saucer during flight and promote a rapid rotation of the annular body in a direction opposite to that of the propeller.

10 Claims, 4 Drawing Figures

FLYING SAUCER TOY

BACKGROUND OF THE INVENTION

1. Field of the Invention

This invention relates to toy flying saucers, and more particularly, to the incorporation of air foils integral with the annular body to facilitate saucer stabilization during flight.

2. Description of the Prior Art

Toy flying saucers which incorporate motor driven propellers to induce air flow vetically downward through a central opening within an annular saucer body to provide lift to the saucer body have enjoyed popularity within the past few years. Such flying saucer toys are the subject of a number of patents including U.S. Pat. Nos. 2,949,693 to McRoskey; 3,394,906 to Rogers; 3,477,168 to Tordglen, Jr.; and 3,568,358 to Bruce. Each of these flying saucer toys has involved an annular body defining a central vertical opening having mounted therein a model airplane engine or similar motor for driving a shaft in rotation coaxial with the annular body and the central opening and supporting a propeller for rotation within the opening of the annular body, and wherein, in some manner, the annular body incorporates a second propeller or fins fixed to the body which effect stabilization to the flying saucer toy by causing a slow rotation of the annular body in a direction opposite to that of the propeller.

Further, attempts have been made to influence the flight of such toy aircraft by causing the central opening within the annular body to assume a cylindrical shape or conical shape which either diverges or converges in the direction of air flow through the central opening. In some flying saucer toys, by enlarging the stabilization fins to the point where such fins which either project radially within the central opening of the annular flying saucer body, or radially outwardly of the body, act as major lift producing devices due to their rotation in a direction opposite to that of the propeller inducing the primary lift force, to favorably influence both lift to the aircraft and stabilization of the aircraft during such flight.

In order to create an annular body of some size but of low mass, U.S. Pat. No. 3,568,358 employs a hollow annular body of relatively thin wall construction. It is to this type of flying saucer toy that the present invention is directed, and the invention constitutes an improvement which improves the lift capability of the aircraft while maximizing the stabilizing and spin producing characteristics of these elements.

SUMMARY OF THE INVENTION

The toy flying saucer of the present invention comprises an annular body which is generally frustoconical in cross section including upper and lower walls which converge in a radially outward direction joined at their radially inboard ends by a sidewall which is inclined upwardly and outwardly to define an upwardly diverging conical axial opening. A motor mount which spans the opening supports a motor whose drive shaft is disposed along the vertical axis of the body with propeller means fixed to the sahft for creating an air flow downwardly through said axial opening to lift the body vertically upward. A plurality of circumferentially spaced tetrahedron shaped fins extend outwardly from the lower walls of the body and lie outside of the axial opening and are pitched opposite to the propeller means. Preferably, the tetrahedron shaped fins are angulated slightly towards the center of the annular body and may comprise arcuate inner and outer sidewalls which are concave towards the body axis. An end wall which may be flat for each fin is preferably inclined outwardly of the body and in the direction of body spin. The body may comprise a unitary hollow molded plastic shell with tetrahedrons integrally molded therein within the bottom wall. The tetrahedrons may be four in number and positioned at equally spaced circumferential positions.

DESCRIPTION OF THE PREFERRED EMBODIMENT

By reference to the figures, it may be seen that the flying saucer toy indicated generally at 10 comprises essentially four individual components: a molded hollow plastic annular body indicated generally at 12, a pair of V-shaped motor supports or struts 14, a model airplane engine 16, and a single blade propeller 18.

Figure 4:
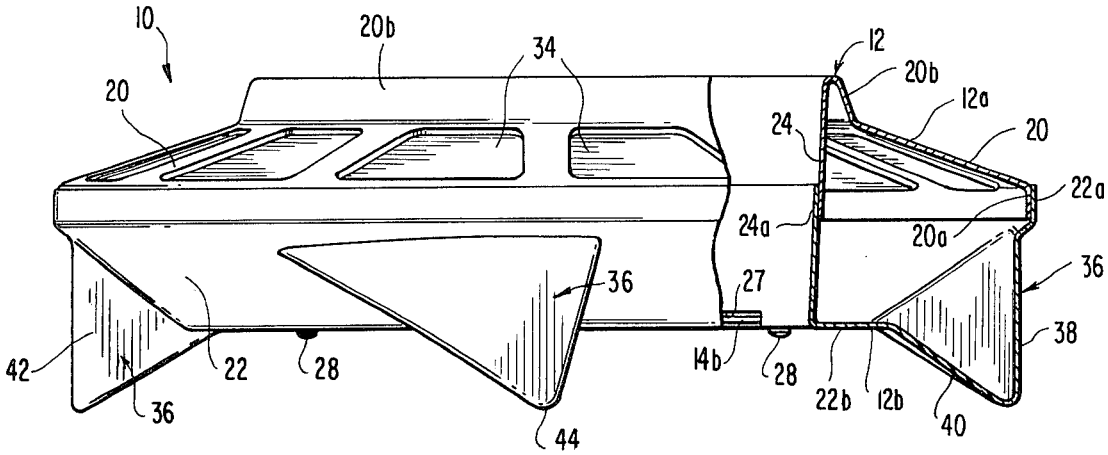
FIG. 4 is a side elevational view of the flying saucer toy partially broken away.

The annular body 12, whose make up and construction may be best seen in FIG. 4, is formed of a suitable plastic material being vacuum molded or the like, and comprising upper and lower sections or halves **12*a* and 12*b* joined at a horizontal center line although it may be blow molded as a single element. The annular body 12 formed by joined sections 12*a* and 12*b* comprises an upper wall 20 and a lower wall 22 which converge towards each other in a radially outward direction. The walls 20 and 22 terminate in integral cylindrical flange portions 20*a* and 22*a* which overlap. The two halves or sections 12*a*, 12*b* of the body are further joined at sidewall 24 which defines an axial frustoconical opening 26 within the center of the annular body 12, the opening 26 diverging in an upward direction or conversely converging in a downward direction. Sidewall 24 in this case is formed by the upper and lower halves or sections 12*a*, 12*b* of the body 12 at overlap 24*a***, the sections or halves being suitably joined by adhesive or by thermoplastically bonding under conventional plastic fabrication techniques.

Figure 1:
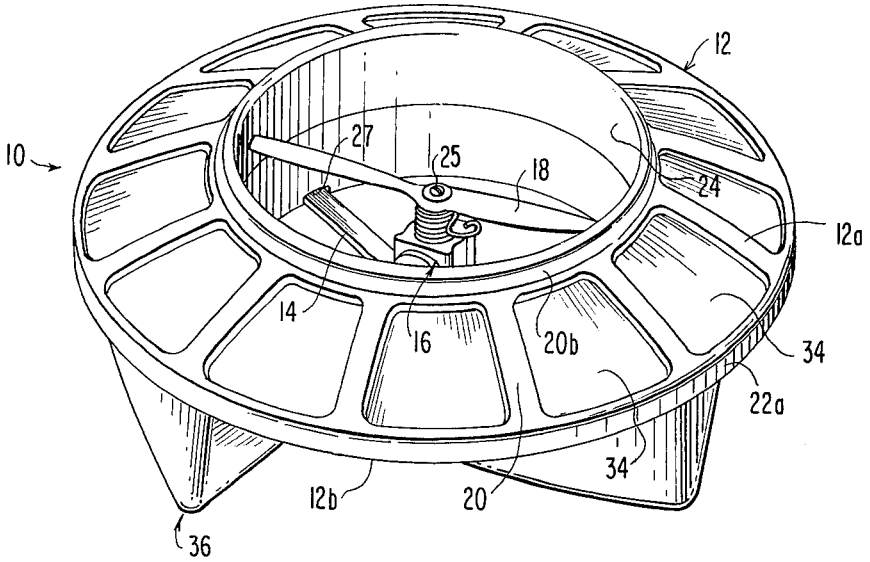
FIG. 1 is a perspective view of the improved flying saucer toy of the present invention in a preferred form.
Figure 2:
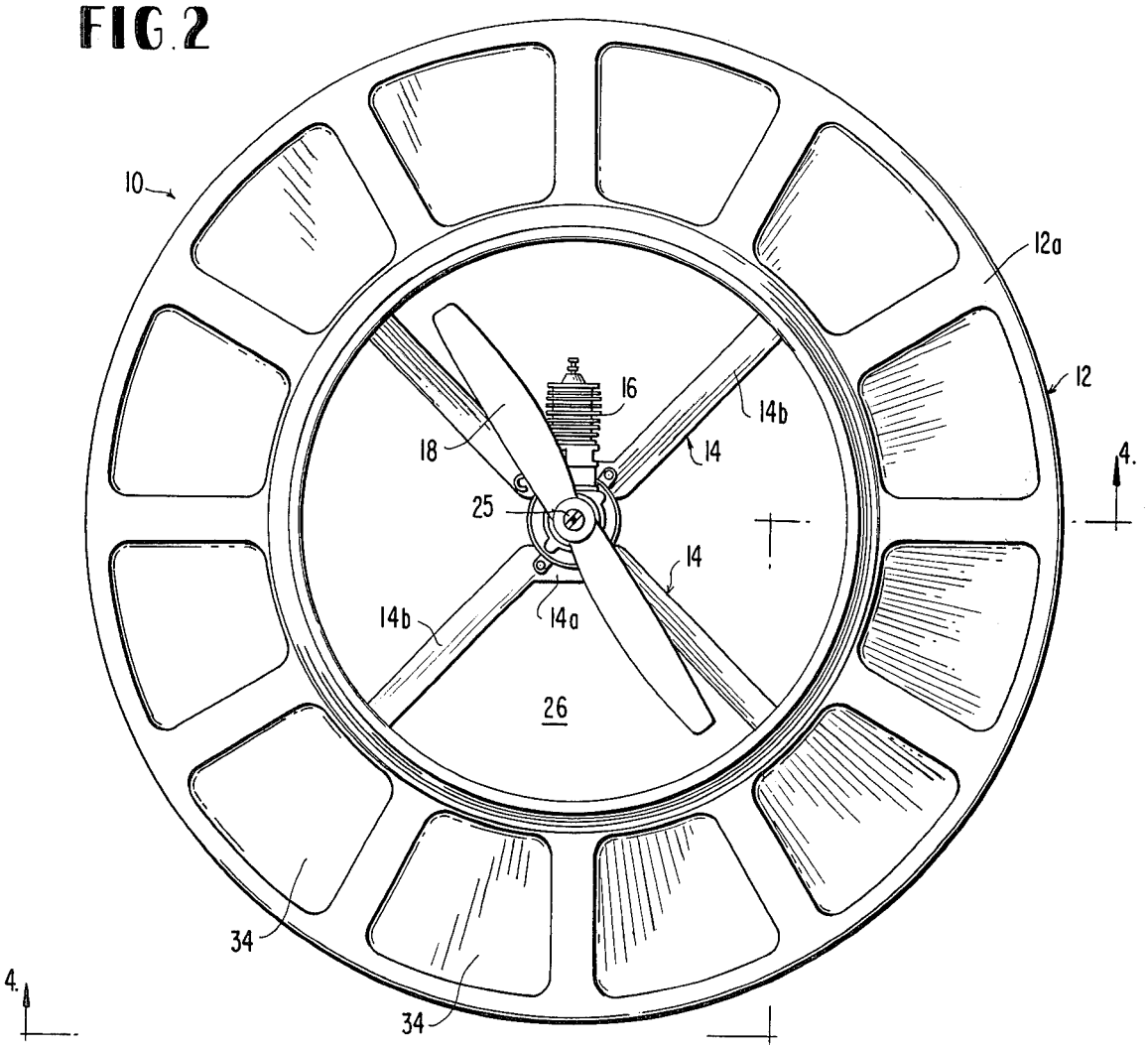
FIG. 2 is a top plan view of the flying saucer toy of FIG. 1.

Four holes 27, FIG. 1, are formed within the sidewall 24 near the bottom of the vertical opening 26 defined by the sidewall 24 of the flying saucer body 12. Further, the bottom wall 22 of the body includes a horizontal, flat, annular portion **22*b* which extends radially outward of sidewall 24 and upon which rests the radially outboard ends of the generally V-shaped engine supports or struts 14. The engine supports or struts 14 have a short length base portion 14*a* which joins the two legs 14*b* together, these members being formed of plastic or the like. The bases 14*a* face each other but are spaced apart a short distance which is less than the thickness of the model airplane engine 16. The outer ends of the legs 14*b* may be suitably fixed to lower wall portion 22*b* of bottom wall 22 by screws 28 or the like. The model airplane engine 16 may comprise a commercially manufactured "Cox" engine, having a cylindrical body 30 which rests upon the base portions 14*a* of struts 14 and may be screwed thereto by means of screws 32. The engine 16 includes a vertical drive shaft 25 fixedly supporting the single blade propeller 18 at its center for rotation about a vertical axis coinciding with the vertical axis of the saucer body 12. The propeller 18** may comprise multiple blades if desired.

The surface indentations 34 molded into the upper wall 20 of the saucer body 12 are for esthetic purposes only.

Figure 3:
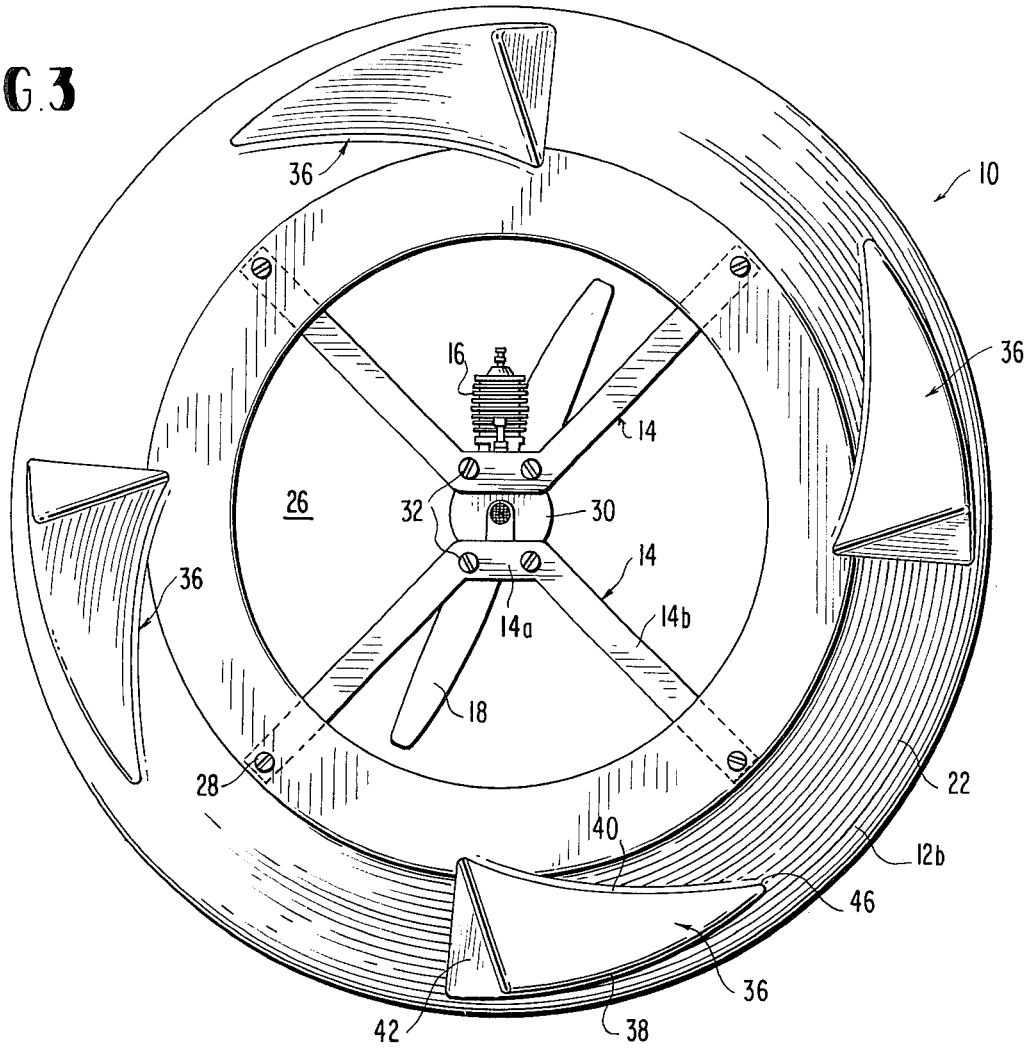
FIG. 3 is a bottom plan view of the flying saucer toy.

An important aspect of the present invention is the incorporation of integrally molded tetrahedron shaped fins indicated generally at 36 within the bottom wall 22 at equally spaced circumferential positions to give a rapid spin to the suacer body 12 in a direction opposite to that of the propeller 18 and to stabilize and provide lift capability of the aircraft. The fins 36 each comprise an arcuate outer wall 38, an arcuate inner wall 40, both of which are concave in the direction of the axis of the body 12, and a flat end wall 42 at the end opposite to the direction of rotation of the body 12, the end wall being inclined in the direction of body spin, that is, at the end toward the apex 46 of walls 38 and 40. It is preferred that the tetrahedron shaped fins 36 angulate slightly toward the center of the annular body 12 in the direction of rotation of that body. This may be best seen by reference to FIG. 3 which is a bottom plan view of the improved toy flying saucer of the present invention.

Further, it is preferred that the outer wall 38 is generally vertical, that is, parallel to the axis of the saucer body 12, although as stated previously, the wall 38 is concave in the direction of that axis and angulates towards the center of the annular body in the direction of rotation of that body. The tips 44 of the angulated tetrahedron shaped fins 36 constitute landing skids for minimizing damage to the toy during landing and for permitting the craft to rest on the fins prior to flight.

It may be further noted that the sidewall 24 is extended relative to the plane of intersection of the major surface area of the upper wall 20, and sidewall 24, and that the upper wall 20 includes therefore a sharply inclined radially inner portion **20*b* which meets the sidewall 24 at a position above the plane of the propeller 18. This acts partially as a safety device tending to discourage the person flying the craft from placing his hand into the vertical opening 26** while holding the craft and prior to release of the same.

In operation, as is conventional with such "Cox" model airplane engines, the back of the engine comprises a complete gas tank storing a small amount of special liquid fuel. After filling the engine, the engine needle valve should be tightened down and then reversed approximately two and one-half turns. By the use of a "Cox" starter kit, the engine may be started and should be run at least twice prior to attempting flight. In flying the flying saucer toy 10, the operator after starting the engine must hold both sides of the body 12 such that the body is essentially horizontal and given a slight rotation of the body in the direction in which the fins point, that is, clockwise in FIG. 1, with the propeller rotating counterclockwise to provide a down draft through the vertical opening 26. As a result, the lift causes the aircraft to rise while the aircraft continues to rotate clockwise to the extent of depleting the fuel carried by the gas tank.

While the aircraft body has been shown as constituting a hollow molded plastic body, it is obvious that the body could be solid although it is necessary to incorporate in such body a plurality of tetrahedron shaped fins projecting outwardly of the lower wall 22 and radially outside of the body opening and pitched in opposition to that of the propeller means.

While the invention has been particularly shown and described with reference to a preferred embodiment thereof, it will be understood by those skilled in the art that various changes in form and details may be made therein without departing from the spirit and scope of the invention.

What is claimed is:

1. A toy flying saucer comprising:

an annular body, said annular body being generally frustoconical in cross section including upper and lower radial walls converging in a radially outward direction and joined at their radially inner ends by a sidewall which extends generally vertically therebetween and which defines an axial opening therein, motor support means spanning said opening and fixed to said body at circumferentially spaced positions, a motor mounted on said support means and having a drive shaft disposed along the vertical axis of the body, propeller means fixed to said shaft for rotation at right angles to the shaft axis to create air flow downwardly through said opening to lift the body vertically upward, and a plurality of circumferentially spaced tetrahedron shaped fins extending outwardly from the lower wall of said body, radially outside of said body opening and pitched opposite to said propeller means.

2. The toy flying saucer as claimed in claim 1, wherein said tetrahedron shaped fins are angulated slightly towards the center of said annular body in the direction of body rotation.

3. The toy flying saucer as claimed in claim 1, wherein each of said tetrahedron shaped fins comprise arcuate inner and outer sidewalls which are concave towards the body axis and are joined by a flat end wall.

4. The toy flying saucer as claimed in claim 2, wherein each of said tetrahedron shaped fins comprise arcuate inner and outer sidewalls which are concave towards the body axis and are joined by a flat end wall.

5. The toy flying saucer as claimed in claim 3, wherein said end wall is inclined outwardly from said body bottom wall in the direction of body spin.

6. The toy flying saucer as claimed in claim 4, wherein said end wall is inclined outwardly from said body bottom wall in the direction of body spin.

7. The toy flying saucer as claimed in claim 1, wherein said body comprises a hollow molded plastic shell with integrally molded tetrahedrons at circumferentially spaced positions along the bottom wall thereof.

8. The toy flying saucer as claimed in claim 3, wherein said body comprises a hollow molded plastic shell with integrally molded tetrahedrons at circumferentially spaced positions along the bottom wall thereof.

9. The toy flying saucer as claimed in claim 6, wherein said body comprises a hollow molded plastic shell with integrally molded tetrahedrons at circumferentially spaced positions along the bottom wall thereof.

10. The toy flying saucer as claimed in claim 9, wherein said tetrahedron shaped fins are four in number at equally circumferentially spaced positions.

* * * * *